United States Patent [19]

Acevedo

[11] 3,982,557

[45] Sept. 28, 1976

[54] FLUID VALVE WITH FLOAT ACTUATOR

[76] Inventor: Ignacio Acevedo, 4066 Fenwick Road, Columbus, Ohio 43220

[22] Filed: Apr. 16, 1975

[21] Appl. No.: 567,253

Related U.S. Application Data

[63] Continuation-in-part of Ser. No. 471,436, May 20, 1974, abandoned.

[52] U.S. Cl. ..... 137/441; 137/445; 137/446; 137/448; 137/426; 137/614.2

[51] Int. Cl.[2] ..... E03D 1/33; F16K 31/18

[58] Field of Search ..... 137/448, 446, 445, 441, 137/436, 614.2, 533, 533.17, 437; 251/237, 238, 239, 258, 257

[56] References Cited

UNITED STATES PATENTS

| | | | |
|---|---|---|---|
| 1,109,169 | 9/1914 | LeMay | 137/441 X |
| 1,512,017 | 10/1924 | Field | 251/239 X |
| 1,943,769 | 1/1934 | Melio | 137/441 |
| 2,271,419 | 1/1942 | Egan | 137/614.2 X |
| 2,559,046 | 7/1951 | Peters | 137/448 X |
| 2,608,990 | 9/1952 | Crockett | 137/437 X |
| 3,038,491 | 6/1962 | Beazley | 137/426 |
| 3,323,468 | 6/1967 | Thompson | 137/533.17 X |
| 3,398,927 | 8/1968 | Ruter | 137/426 X |

*Primary Examiner*—Alan Cohan
*Attorney, Agent, or Firm*—Mahoney & Stebens

[57] ABSTRACT

A fluid flow control valve for automatic fluid level control in a reservoir is provided having a valve chamber with axially aligned inlet and outlet orifices, a valve closure element disposed in the chamber and having an actuating stem projecting outwardly through the outlet orifice, and a float-type lever arm engageable with the actuating stem. The valve closure element is normally maintained in closing relationship to the outlet orifice by the pressurized fluid at the inlet side with the valve designed for operation over a wide range of fluid pressures. Movement of the lever arm in response to the fluid level is effective in rocking the valve closure element through its actuating stem to a position where fluid may flow through the outlet orifice. The lever arm is provided with a weighted float to assure positive operation of the valve in high pressure fluid systems and the lever arm is formed with means readily permitting adjustment thereof to precisely determine the fluid level in the reservoir. The inlet orifice is provided with a check valve preventing reverse fluid flow through the valve in the event of loss of inlet fluid pressure.

10 Claims, 7 Drawing Figures

FLUID VALVE WITH FLOAT ACTUATOR

This application is a continuation-in-part of patent application Ser. No. 471,436 filed May 20, 1974 by Ignacio Acevedo, now abandoned.

BACKGROUND OF THE INVENTION

Flow control valves for the water flush tank for toilets have heretofore comprised float actuated valves which have a valve element held in a closed position by the float when the tank is full. Prior art valves of this type have a float which is mechanically coupled to the valve element. Valves of this type have not been found completely satisfactory as the float must function to hold the valve closed against the inlet water pressure and the linkage necessary to effect direct mechanical coupling of the float is relatively complex and frequently becomes incorrectly adjusted after a prolonged period of use.

Float actuated valves of a type which have a valve element held in a closed position by the inlet water pressure and adapted to the vertically oriented mounting required for flush tanks are known in the prior art but these valves have not proven to be completely satisfactory. Valves illustrative of the known prior art are disclosed in U.S. Pat. Nos. 2,559,046 and 1,943,769. The valve element in patent No. 1,943,769 is of a construction and mounting which is actuated in a longitudinally axial direction only by a lever arm provided with a float. An inherent disadvantage of this type of valve construction and operation is that a relatively large force is required to axially displace the valve element on initial opening movement. Consequently, a valve of this type is generally restricted to relatively low pressure fluid systems.

A valve of the type illustrated in patent No. 2,559,046 discloses a valve element and lever arm combination of the preferred angular valve displacement type which requires a substantially lesser force to initiate opening of the valve. However, the valve disclosed in this patent is not adaptable for use in a flush tank as it is incapable of providing the necessary divided flow to the tank and to the overflow pipe.

SUMMARY OF THE INVENTION

The fluid control valve provided by this invention incorporates a novel construction particularly adapted to vertical orientation in a water reservoir and providing substantial advantages in operation. Included in the main valve body is a valve closure element that is normally maintained in closed relationship to the outlet orifice by the inlet water pressure thereby substantially eliminating the likelihood of the valves failure with consequent continued water flow. Actuation of the valve closure element is effected through a float and a lever arm which is not directly linked by a mechanism to an actuating stem of the valve closure element. The lever arm is provided with means readily permitting adjustment to achieve precise control in the maximum water level in the reservoir or tank.

The valve closure element includes an actuating stem that projects through an outlet orifice in the main valve body and into a flow directing housing. This actuating stem is engaged by a roller mounted on an end of the float actuated lever arm thereby eliminating any requirement for complex connecting linkage and permitting relatively free operation of the valve closure element.

An extreme range of valve inlet pressures are readily accommodated by the valve of this invention through a novel movable valve element construction and through providing of a weighted float. In accordance with this invention, the movable valve element is preferably fabricated from a light weight material or formed to have a minimal weight thereby capable of being maintained in a closed position by a very minimal inlet pressure. Providing of a weighted float enables operation of the valve at extremely high pressures in that a substantial force for displacement of the valve may be readily obtained through addition of a weight or increased weight to the float. Providing of a weight which is essentially ineffective in the water when the tank is being filled, results in a substantially greater force for actuating the valve to an open position when the tank is emptied thereby enabling the valve to accommodate relatively high inlet pressures.

Also included in the main valve body is a check valve to prevent reverse flow through the valve in the event of loss of water inlet pressure. This check valve is automatically closed by loss of inlet pressure and includes a movable element that moves by gravity into closing relationship to a sealing element. Any fluid remaining in the tank further aids in maintaining the check valve closed by the gravity induced fluid pressure developed in the tank or reservoir.

These and other objects and advantages of this invention will be readily apparent from the following detailed description of an embodiment thereof and the accompanying illustrative drawings.

DESCRIPTION OF THE DRAWING FIGURES

DETAILED DESCRIPTION OF THE ILLUSTRATIVE EMBODIMENT

Figure 1:
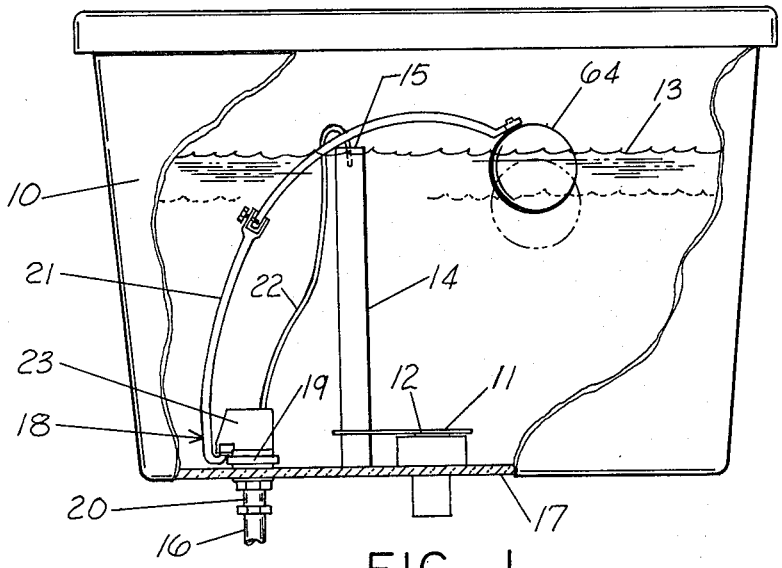
FIG. 1 is a front elevational view of a water flush tank for a toilet with portions of the front wall thereof broken away to indicate location and relative positioning of the valve embodying this invention and other components.

Having reference specifically to FIG. 1 of the drawings, there is illustrated a water tank 10 of a type specifically designed for utilization in conjunction with a toilet. This tank includes a large water outlet 11 which is connected to a toilet bowl (not shown) provided with a valve member 12 which cooperatively functions to rapidly release and permit drainage of substantially all of the water that is normally maintained in the tank. The normal water level is indicated at 13. Also, positioned in the tank 10 is an overflow pipe 14 having its lower end connected to the outlet 11 permitting water to flow into the toilet bowl and the upper end 15 of the overflow pipe is at a relative elevation which coincides with or is slightly above the desired water level 13. A water supply or inlet pipe 16 is provided for connection with the tank at a bottom wall 17. This supply inlet pipe 16 is connectable with a suitable pressurized source of water.

Positioned interiorly of the tank 10 is the inlet water control valve 18 embodying this invention. This valve comprises a main body 19 provided with a coupling and mounting pipe section 20 adapted to be rigidly secured in fluid tight relationship in a mounting opening formed in the bottom wall 17 of the tank. The lower end of this pipe section 20, which section is vertically oriented, is connected to the supply pipe 16. Mechanically coupled with the valve 18 is a float-type actuating arm 21. Extending from the valve 18 is a flexible tube 22. The free end of the tube 22 extends upwardly and is positioned in the upper opened end 15 of the overflow pipe 14. A housing 23 is mounted on the upper end of the body 19 with the tube 22 being connected thereto in fluid flow communicating relationship to the interior of the housing.

Figure 3A:
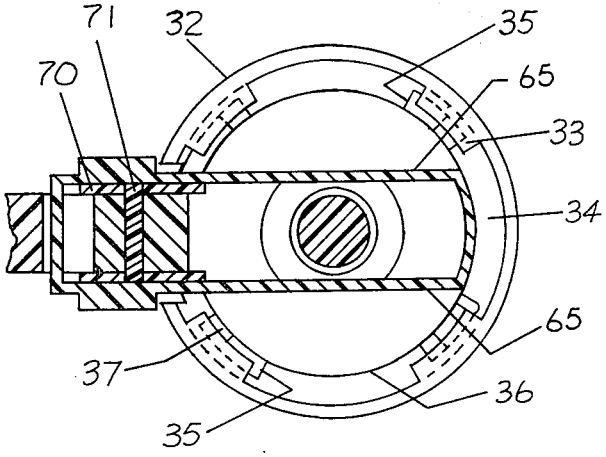
FIG. 3A is a transverse sectional view taken along line 3*a*—3*a* of FIG. 4.
Figure 2:
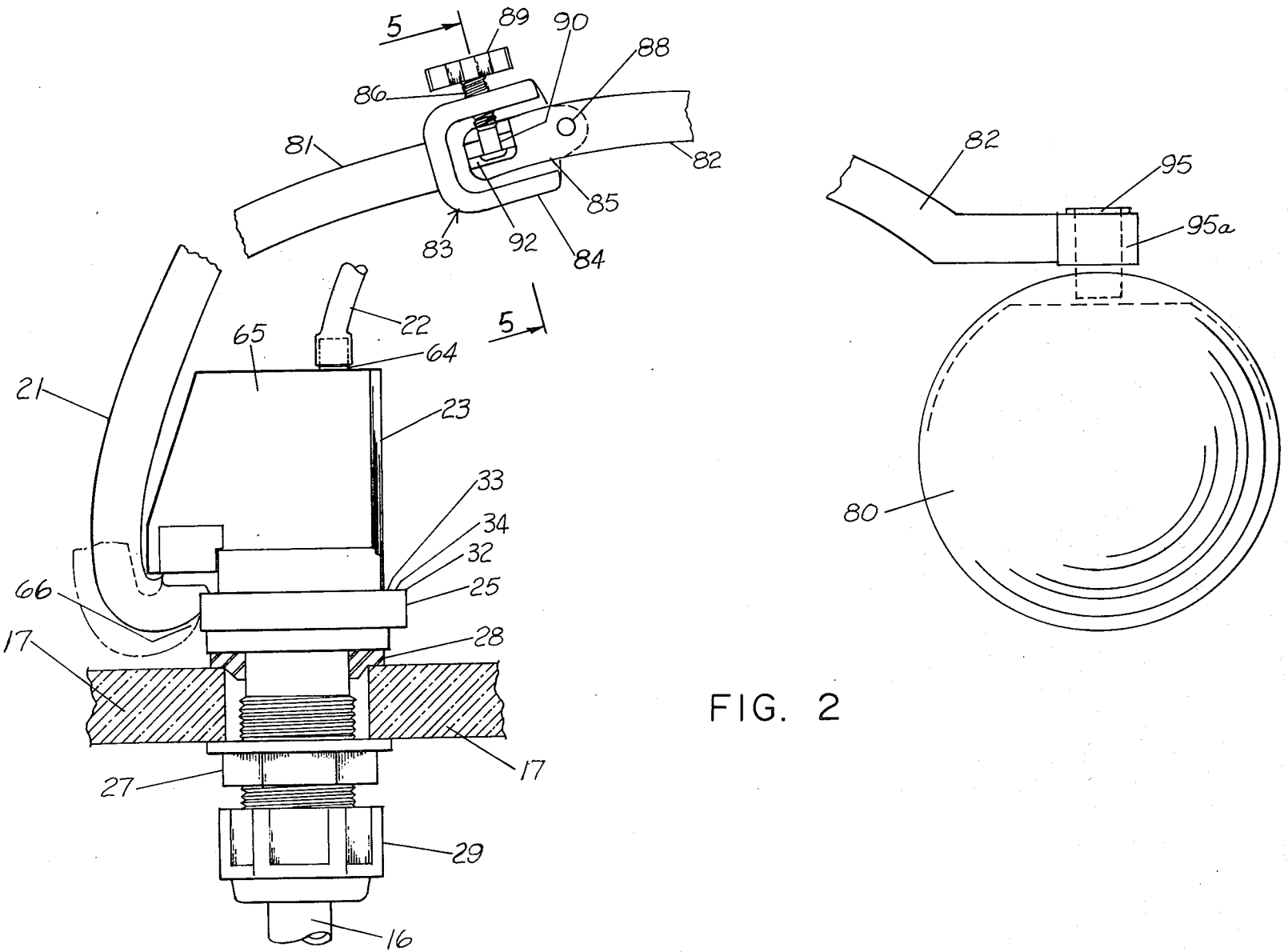
FIG. 2 is a side elevational view of the valve and float actuating means shown on an enlarged scale.
Figure 3:
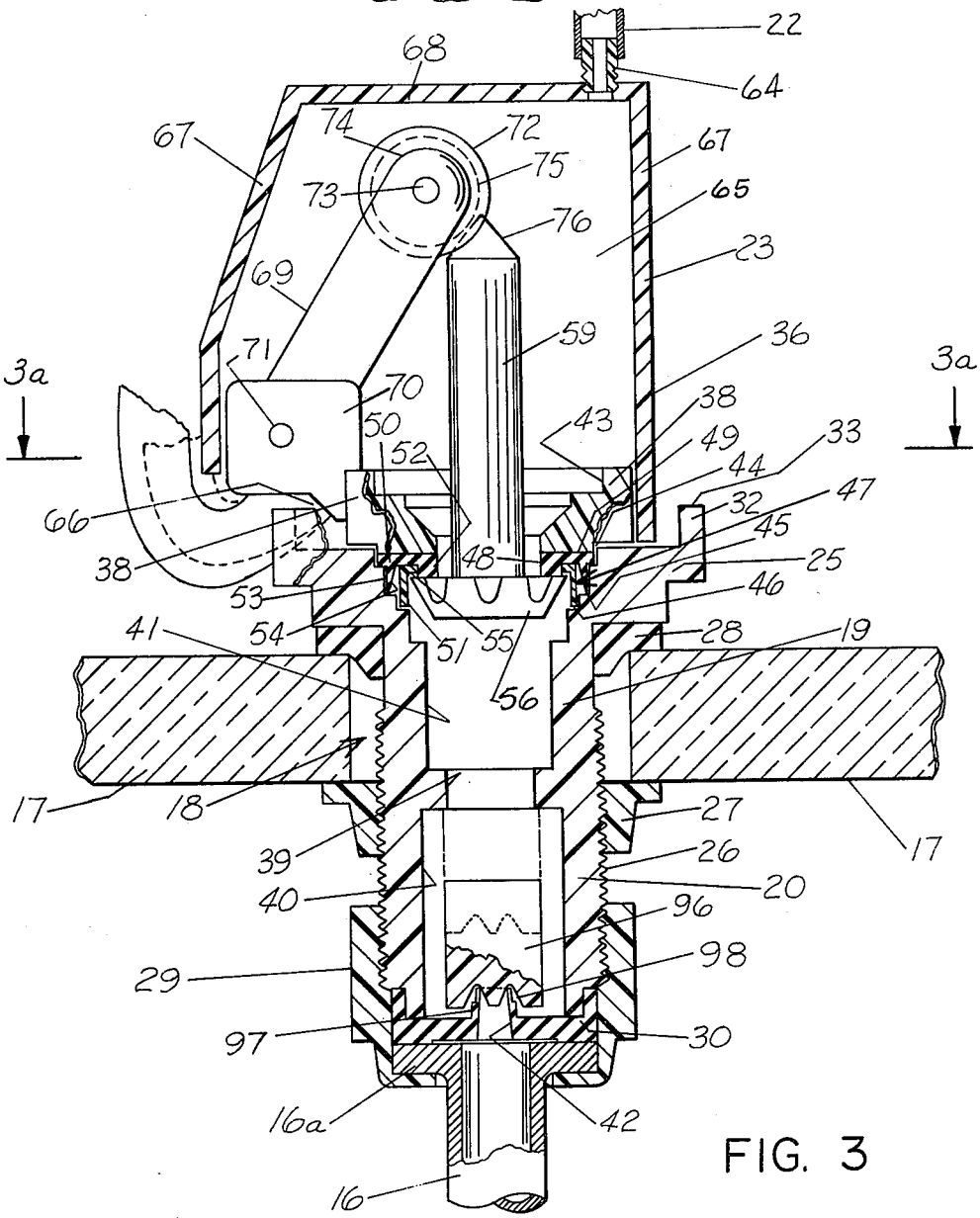
FIG. 3 is a medial vertical sectional view on an enlarged scale of the valve as seen in FIG. 2.

As can be best seen in FIG. 3 the water control valve 18 is fabricated in several sections with the main body 19 being integrally formed with the mounting pipe section 20. One end of the body 19 is formed with a flange 25 forming a mounting base. The pipe section 20 and a substantial portion of the body 19 are formed with screw threads 26 with a flanged mounting nut 27 threaded onto the pipe section which functions to clamp the unit to the bottom wall 17 of the tank in cooperation with the flange 25. A resilient sealing element 28 is interposed between the flange 25 and the bottom surface of the tank wall 17 (as seen in FIG. 2) to provide a fluid tight seal. A conduit coupler 29 is threaded onto the lower end of the pipe section 20 and secures a flanged end 16*a* of the inlet pipe 16 in fluid tight relationship to the end of the pipe by means of a sealing disc 30 as seen in FIG. 3.

Rigid assembly of the housing 23 with the main body 19 is accomplished by an interlocking lug configuration which eliminates the need for the usual fastening devices such as screws. Integrally formed with the flange 25 around the outer circular periphery thereof is an axially projecting cylindrical ring 32. On the ring 32 integrally formed lugs 33 extend a distance radially inward in angularly spaced relationship to form a number of circumferentially spaced slots 34 therebetween as can be best seen in FIG. 3 and 3*a* and a mating number of lugs 35 are formed on the outer peripheral surface of a cylindrical extension 36 of the housing 23. These lugs 35 are formed with inclined surfaces 37 on the upper surface thereof to provide axial displacement of the housing and its cylindrical extension 36. In assembly of the housing 23 with the main body 19, the extension 36 is first oriented to align the lugs 35 with respective slots 34. Upon axial insertion of the lugs through the slots, the housing 23 is rotated about its axis with the inclined surfaces 37 being revolved into engagement with the inwardly facing surface of the annular ring 33. Continued rotation of the housing relative to the main body 19 will then result in axial displacement of the base plate 36 toward the opposed end face of the flange 25.

Interposed between the end face of the flange 25 and the base plate 36 of the housing is a circular plate 38. This circular plate has a diameter less than the internal diameter of the annular ring 33 to permit axial insertion through the ring into contact with the flange. The relative axial or thickness dimensions of the circular plate 38 and base plate 36 and associated lugs are selected so that, in addition to the components having adequate structural strength, the axial displacement of the housing base plate during interlocking assembly with the flange will apply an axial force resulting in rigid clamping of the plate to the flange.

An axial bore 39 extends through the main body 19 and mounting pipe section 20 with both ends of this bore opening at the respective ends of the valve. This bore 39 is relatively enlarged at either end thereby defining respective valve chambers 40 and 41. A coaxial passage 42 formed in the sealing disc 30 permits flow of water from the inlet pipe 16 through the first valve chamber 40, the axial bore 39 and out through the open end of the second valve chamber 41. A coaxial aperture 43 is formed in the circular plate 38 to permit outflow of water from the second valve chamber 41.

A series of three annular recesses 44, 45 and 46 of progressively smaller diameter are formed in the outwardly facing end of the flange 25 in coaxial relationship to the second valve chamber 41. Positioned in the recesses is a sealing device 47 having a central aperture 48 aligned with and of substantially the same diameter as the aperture 43 in the plate 38. Clamping of the plate 38 to the flange 25 as previously described secures the sealing device 47 in the recess through contact with a circular boss 49 formed on the end face of the plate and which projects into the first recess 44.

The sealing device 47 utilized in the valve of this invention preferably comprises a resilient element 50 and a rigid element 51. The resilient element 50 is of circular disc form having an outer diameter to closely interfit in the first recess 44 and of a thickness to be securely clamped by the boss 49 on the plate 38 against the end wall of the first recess. An annular ring 52 is formed with the disc portion in circumscribing relationship to the aperture 48 and projects a distance axially inward. Another annular ring 53 is formed with the disc in radially inward relationship to the outer periphery of the disc and is of a diameter to interfit within the second recess 45. This ring 53 also projects axially inward from the face of the disc but not to such an extent that it will contact the end wall of this recess. It will be noted that the outer periphery of the second ring 53 comprises a cylindrical surface to contactingly engage the opposed cylindrical wall of the recess and form a fluid tight seal threwith while the inner face 54 of the ring is inclined resulting in a V-shaped cross-section.

The rigid element 51 comprises a circular ring formed with a diameter to interfit in the third recess 46 and having an axial dimension so as to engage the end face of the resilient element 50. The clamping effect of the plate 38 thus also secured the rigid element in the desired position. Integrally formed with the ring at the end adjacent the resilient element is a radially inwardly projecting rib 55 which terminates at the annular ring 52. This rib 55 is of a thickness that annular ring 52 projects a slight distance axially inward of the exposed end face of the rib.

Positioned in the valve chamber 41 is a relatively movable valve element 56. This valve element 56 comprises a circular disc having a tapered outer peripheral rim 57 which has a maximum diameter that permits interfitting within the rigid element 51 of the sealing device 47. The opposed axial end faces of the element are flat surfaced with an uppermost surface 58 normally bearing against the annular ring 52 and forming a fluid tight seal therewith when the valve element is in a closed position. Rigidly secured to the valve element 56 is an axially extending elongated actuating stem 59. The free end of the actuating stem 59 which is cylindrical extends upwardly through the coaxial aperture 43 of the plate 38 and the central openings in the sealing device 47. It is of a length to extend a substantial distance upwardly into the interior of the housing 23 as will be hereinafter explained in detail. It will also be noted that the valve element 56 has a series of circumferentially spaced slots or grooves 60 which extend axially across the tapered peripheral rim 57 of the valve element. These grooves 60 provide greater area for fluid flow as well as permitting passage of solid particles or impurities.

This illustrated sealing device 47 provides specific advantages in this valve as to both effectiveness in forming a fluid tight seal and greatly extended life capability. When the valve element 56 is maintained in the illustrated closed position of FIG. 3, the upper surface 58 is held in contacting engagement with the end surface of the annular ring 52 of the resilient element by the fluid pressure acting within the second valve chamber 41. The fluid pressure will tend to compress the resilient element; however, the annular ring 52 is dimensioned to prevent contact of the valve element 56 with the rigid element 51 of the sealing device and thereby maintain a particularly effective fluid tight seal.

Figure 4:
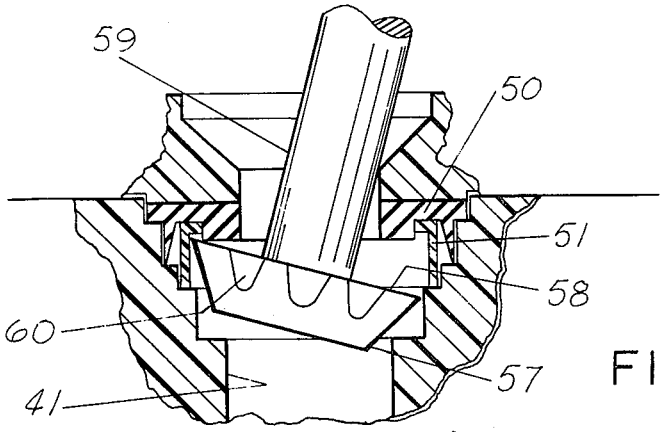
FIG. 4 is an enlarged fragmentary portion of FIG. 3.

Actuation of the valve element 56 to permit fluid flow therethrough is illustrated in FIG. 4 which is an enlargement of this area of the valve to better illustrate the advantages of this sealing device 47. As will be subsequently described, actuation of the valve results from a lateral displacement of the actuating stem 59 which rocks the valve element 56 to the illustrated angular position where the angular corner at the rim 57 contacts the surface of rib 55 of the rigid element 51. This prevents the relatively sharp edge of the valve element 56 from causing rapid deterioration of the resilient element 50. It will also be noted that actuation of the valve element 56 to this position provides a substantial opening through which water may flow from the valve chamber 41 and through the central aperture of the sealing device 47 and coaxial aperture 43 in the circular plate 38. The grooves 60 enhance the rate of water flow.

Although the valve element 56 in response to fluid pressure acting directly on the valve, and which pressure also acts on the rigid seal element 51, may tend to axially displace the rigid seal element, this will not result in any loss of sealing effectiveness. The reason for this is that the annular ring 52 maintains an effective seal irrespective of any axial displacement. A fluid seal is not formed between the rigid seal element 51 and the surface of recess 46 thereby permitting fluid under pressure to enter recess 45 where it will act on the inner face 54 of ring 53. This results in compression of the ring 53 against the cylindrical wall of recess 45 and maintenance of an effective fluid seal which is improved with an increase in fluid pressure.

The actuating stem 59 as previously stated extends axially upward and into the housing 23 for engagement with the actuating mechanism. The housing 23 is of open bottom shell form having a short tube 64 opening to the interior and projecting a distance from the top of the housing. The flexible tube 22 is secured to this short tube 64. As can be best seen in FIG. 3, the housing 23 includes two vertical side walls 65 which are speced apart a distance to receive the actuating mechanism and extend in one direction a distance beyond the outer periphery of the flange 25 thus defining a discharge opening 66. Both ends of the housing are closed by end walls 67 and the top is closed by a top wall 68 with the short tube 64 being secured in the top wall.

The float-type actuating arm 21 comprises a bent lever having an end portion 69 that extends into the housing 23 through the discharge opening 66. A pair of upstanding, spaced parallel lugs 70 are integrally formed with the circular plate 38 with the arm portion 69 journalled on an axle pin 71 for pivotal movement in a vertical plane parallel to the side walls of the housing. The end portion 69 projects upwardly and across the interior of the housing 23 toward the valve actuating stem 59. Operating interconnection of the arm 21 with the valve actuating stem 59 is effected in accordance with this invention by a cam roller 72 which is journalled on an axle 73 and mounted between bifurcated arms 74 formed at the extremity of end portion 69 of the arm 21. The roller 72 is supported for rotation in a vertical plane and has a peripheral groove 75 configured to cooperatively engage the cylindrical surface of the actuating stem 59. Pivotal movement of the arm 21 in response to fluid level in the tank results in swinging movement of the arm causing the roller 72 to roll along the actuating stem 59 and pivoting of the valve element 56 along with its actuating stem 59.

In accordance with this invention, the upper end portion of the valve elements actuating stem 59 is tapered to form a conical surface 76. This configuration enables the valve to have a relatively fast closing action during the last stages of closing movement. When the valve is opened with the actuating stem 59 displaced to the broken line position in FIG. 3, the actuating arm end portion will have been rotated clockwise causing the roller 72 to roll downwardly on the cylindrical surface of the stem. As will be further explained with reference to other figures of the drawings, filling of the tank 10 will cause counterclockwise rotation of the actuating arm 21 at a rate proportional to the rate at which the tank fills. As the water level approaches the desired maximum level, the roller 72 rolls onto the conical surface 76 and thus permits the valve to close at a relatively rapid rate.

Since the water flush tank 10 is normally constructed with the inlet 16 at one side necessitating mounting of the valve 18 at this location, the actuating arm 21 is formed to extend upwardly in outwardly spaced relationship to the end wall 67 and then laterally across the top of the housing 23. The spacing of the arm is such as to avoid interference with the housing during normal movement causing actuation of the valve element 56 although the arm is formed to engage the housing wall 67 and thus be limited in its clockwise movement. In the illustrated embodiment, a portion of the arm 21 extends downwardly and outwardly through the discharge opening 66 and then upwardly and over the housing.

Figure 5:
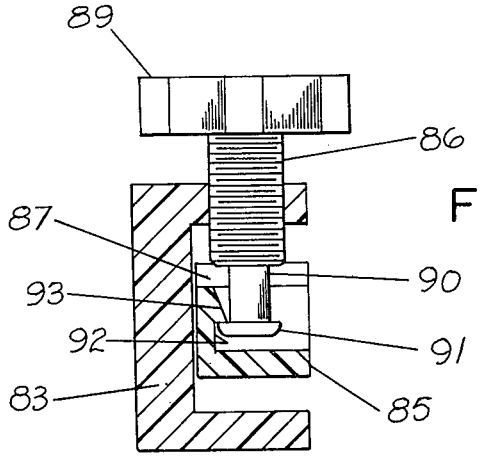
FIG. 5 is a sectional view on an enlarged scale taken along line 5—5 of FIG. 2.

Attached to the outer end of the arm 21 is a float 80 which responds to the water level in the tank within the limits of pivotal movement of the arm. To provide a degree of adjustment in the level to which the tank will be filled, the actuating arm 21 is fabricated in two articulated sections 81 and 82 interconnected by an adjustable coupler 83. This coupler 83 as can be best seen in FIGS. 2 and 5 comprises an open sided channel 84 formed with the inner arm section 81, a slotted tongue 85 formed with the outer arm section 82 and a connecting screw 86. A closing side wall 87 of the channel 84 is provided at its outer end with a transversely projecting pin 88 which extends into an aperture formed in the outer arm section 82. The outer arm section 82 is thus pivoted relative to the inner arm section and may be selectively angularly positioned by means of the connecting screw 86. One end of the screw 86 which is threaded through a wall of the channel 83 is provided with a thumb wheel 89 while the opposite end is provided with an extension 90 terminating in an enlarged head 91. This enlarged head 91 interlockingly engages with an elongated recess 92 formed in the slotted tongue 85 to provide positive relative positioning of the two arm sections. Assembly of the sections is facilitated by the inclined surface 93 with enlarged head 91 of the screw readily riding up this surface and into the recess where it is retained. Adjustment of the screw 86 thus positively positions the two sections of the arm 21.

This float 80 is of a hollow body construction formed with a filling tube and connector post 95 at the top. A portion of the filling tube and connector post 95 projects a distance outwardly from the cylindrical float body having the end walls vertically disposed and is frictionally engageable with a bifurcated end 95a of the outer arm section 82. The filling tube portion projects a distance into the interior of the float 80. By filling the float with water to the maximum level as dictated by the distance which the tube extends inwardly, the float will have a predetermined air space that determines its effective buoyancy. The weight of the water in the float is ineffective when the float is immersed in the water and the air space is then fully effective.

The valve of this invention is also provided with a check valve to prevent reverse flow of water from the tank 11 in the event that the system pressure should fail. This check valve as is best seen in FIGS, 3 and 6 is incorporated with the main body 19 of the valve and comprises a check element 96 disposed in and movable axially through the first valve chamber 40 in relation to the sealing disc 30. The check element 96 is an elongated bar of square cross-section having a diametrical dimension substantially the same as the diameter of the cylindrical valve chamber 40. Since the axial bore 39 interconnecting the two valve chambers is of a smaller diameter but greater than the width of the check element, and axial displacement of the check element 96 is stopped at the upper end of the chamber as shown in broken lines and water will flow from the chamber and through the axial bore around the end of the check element.

Figure 6:
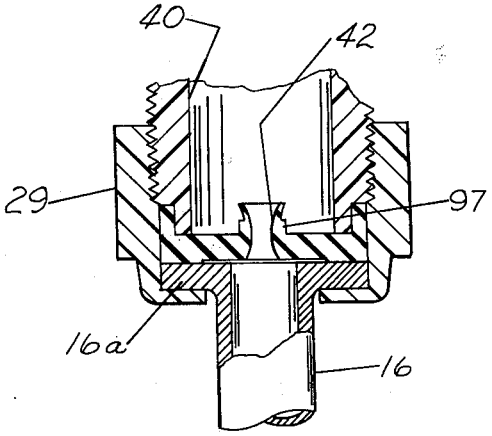
FIG. 6 is an enlarged fragmentary portion of FIG. 3.

Reverse flow of water is prevented when the check element 96 is displaced into axial engagement with the sealing disc 30. An effective seal is obtained by forming the sealing disc 30 formed from a resilient material with an upstanding annular ring 97 in coaxial relationship with the passage 42. A circular groove 98 is formed in the end face of the check element and receives the marginal end portion of the ring 97. It will be noted that the ring 97 is of stepped configuration while the passage 42 is conical to permit a reduced wall thickness. This construction enhances the flexibility of the ring 97 and permits the ring to flare outwardly as shown in FIG. 6 when water flows therethrough providing control over the flow rate and reducing the noise. Loss of water pressure does not result in interference from the valve element 56 as that element is of a diameter greater than that of the axial passage 42 and will be stopped at that point if released from the cam roller 72.

Operation of the valve embodying this invention can be best seen by reference to FIGS. 1, 2 and 3. Assuming that the valve 18 is installed in a water flush tank 10 as previously described and that the tank is filled to the desired level 13, the float 80 will have pivoted the arm 21 to the solid line position in the several figures. The arm end portion 69 will have been pivoted upwardly to a position permitting the valve actuating stem 59 to extend vertically upward. The pressure of the inlet water will exert a force on the valve element 56 to maintain the upper surface 58 in contact with the sealing ring 52 and forming a fluid tight seal against the ring. Water is free to flow into the two valve chambers 40 and 41 through the check valve located at the inlet end.

Lowering of the water level 13 results in pivoting of the arm 21 in a clockwise direction as seen in FIG. 3 causing the cam roller 72 to roll along the actuating stem 59 and push the actuating stem sideways. This movement of the actuating stem 59 rocks the valve closure element 56 to a tilted position as shown in broken lines. Water will then flow outwardly through the aperture 43 and into the housing 23 with the water flow also displacing the check element 96 to the broken line position. A small portion of the water thus entering the housing 23 will flow through the tube 22 and into the overflow pipe 14 to maintain a small water flow into the toilet bowl for the short period of time that the tank 10 is refilling. Most of the water flows out through the discharge opening 66. Since the discharge opening 66 generally remains below water in the tank, there will be little noise generated by the water flow. When the tank has filled to the desired level, the float 80 will have swung the arm 21 to a position again permitting the valve element 56 to form a seal with the ring 52 of the resilient sealing element 50 in response to the inlet water pressure.

Materials found specifically useful in fabrication of this valve have not been discussed in great detail but it will be apparent that any material that is not readily corroded by water would be acceptable. However, it is preferred to use a suitable thermosetting plastic or synthetic resin capable of achieving the required structural strength. A material of this nature, in addition to the desired attribute of being essentially noncorrodable, is relatively light weight which in the case of the valve element 56 with its actuating stem enables the valve to operate and be maintained in a closed position with a minimal water pressure.

It will be readily apparent from the foregoing detailed description of the illustrative embodiment, that an improved valve is provided for water flush tanks. The cam roller engagement with the tapered actuating stem of the valve element permits the desired fast action at the end of the closing cycle. The valve has improved operating characteristics over the prior art valves and the float has adjustability features enabling precise adjustment of the point of valve actuation.

Having just described this invention, what is claimed is:

1. A fluid control valve for maintaining a predetermined fluid level in a reservoir comprising, a valve body having a valve chamber with a fluid inlet and an upwardly opening fluid outlet, a valve sealing device disposed in circumscribing relationship to said outlet, a valve closure element positioned in said valve chamber and normally held in closed relationship to said sealing device solely by fluid pressure in said valve chamber, said element movable into and out of fluid sealing engagement with said valve sealing device and having an elongated actuating stem rigidly secured thereto, said stem extending vertically upward through the outlet and projecting a distance outwardly from said valve body with the outer end portion convergently tapered, and float actuating means including a lever arm pivotably mounted on said valve body for swinging movement relative thereto in a plane parallel to the longitudinal axis of said valve element, said lever arm having a cam follower contactingly engageable with said actuating stem in opening said valve and mounted to move onto the tapered end portion of said stem for increasing rate of movement in closing of said valve element, and a float attached thereto in spaced relationship to said cam follower and positionable within the fluid reservoir to respond to the fluid level therein for actuation of said valve closure element.

2. A fluid control valve according to claim 1 wherein said valve body is provided with a housing having an internal chamber receiving the actuating stem of said valve closure element and a discharge opening, said lever arm extending through said discharge opening.

3. A fluid control valve according to claim 1 wherein said housing is provided with a second discharge opening permitting limited fluid flow therethrough.

4. A fluid control valve according to claim 1 wherein said cam follower is a grooved roller engageable with a cooperatively configured surface of said actuating stem.

5. A fluid control valve according to claim 1 having a check valve positioned to prevent reverse flow through the valve.

6. A fluid control valve according to claim 5 wherein said check valve includes a second valve chamber disposed in preceding relationship to said first mentioned valve chamber, a check element disposed for movement therein, and a resilient sealing disk positioned at an inlet end to said second chamber which cooperatively seals against said check element.

7. A fluid control valve according to claim 6 wherein said sealing disk is formed with an axial flow fluid passage and an annular ring projecting axially from the outlet side of said disk, said check element having a circular groove formed therein for receiving said annular ring in sealing engagement.

8. A fluid control valve according to claim 1 wherein said valve sealing device includes a resilient ring against which said valve element normally seals and a rigid element engaged by said valve element when displaced to an open position.

9. A fluid control valve according to claim 1 wherein said float actuating means includes a weighted float for increasing the valve actuating force when not immersed in the fluid in the reservoir.

10. A fluid control valve according to claim 1 wherein said lever arm includes adjustment means to permit variance in the reservoir fluid level.

* * * * *